United States Patent [19]

Feinstein

[11] Patent Number: 4,752,269

[45] Date of Patent: Jun. 21, 1988

[54] RECONFIGURABLE, INTERCHANGEABLE AND INTERLOCKING PLAYTHINGS, BLOCKS OR CONSTRUCTION PIECES

[76] Inventor: Jonathan Feinstein, 206 Hanshaw Rd., Ithaca, N.Y. 14850

[21] Appl. No.: 861,262

[22] Filed: May 9, 1986

[51] Int. Cl.[4] ..... A63H 33/08

[52] U.S. Cl. ..... 446/124; 446/374

[58] Field of Search ..... 446/101, 124, 374; 403/398, 380

[56] References Cited

U.S. PATENT DOCUMENTS

| | | | |
|---|---|---|---|
| 1,371,619 | 3/1921 | Greenstreet | 446/124 |
| 2,751,706 | 6/1956 | Metal | 446/124 X |
| 3,666,298 | 5/1972 | Reuly | 403/298 X |
| 4,306,373 | 12/1981 | Chatani et al. | 446/124 X |
| 4,564,732 | 1/1986 | Lancaster et al. | 403/381 X |
| 4,598,922 | 7/1986 | Kleinebeune et al. | 403/298 X |
| 4,636,106 | 1/1987 | Waisbrod | 403/298 X |

FOREIGN PATENT DOCUMENTS

| | | | |
|---|---|---|---|
| 940468 | 12/1948 | France | 446/124 |
| 8400600 | 9/1985 | Netherlands | 446/85 |
| 1253810 | 11/1971 | United Kingdom | 446/374 |

*Primary Examiner*—Kenneth J. Dorner
*Assistant Examiner*—Peter R. Brown
*Attorney, Agent, or Firm*—Neuman, Williams, Anderson & Olson

[57] ABSTRACT

Three-dimensional, reconfigurable playthings or blocks may be interconnected in a myriad of designs. A plurality of generally flat blocks of substantially uniform thickness in varying geometric outlines and contours are interconnected through the utilization of defined notches in one or more sides of any of the blocks to be configured. Generally, the notch is substantially equal to the thickness of the various blocks so that they may be interconnected in an orthogonal fashion. Additionally, the blocks, through the utilization of the notch, may be configured in a generally cantilevered fashion through the use of two or more points for contact friction fitting. Use of flexible materials enhances the safety of the blocks in an environment of a children's toy, and additional embodiments utilizing ribbed notches further enhance the interconnection of the blocks to allow additional exercise of imagination in configuring designs.

16 Claims, 11 Drawing Sheets

RECONFIGURABLE, INTERCHANGEABLE AND INTERLOCKING PLAYTHINGS, BLOCKS OR CONSTRUCTION PIECES

BACKGROUND OF THE INVENTION

The present invention relates most generally to systems of interlocking materials which may be readily reconfigured. More particularly, the present invention relates to the art of amusement devices, toys and playthings for both children and adults.

Interlocking materials have long been known in various arts. The use of particularly shaped pieces to construct portions of whole objects is an accepted procedure. For example, bricks and building blocks may be found in any number of interlocking shapes, and mortared or dovetail joints may frequently be used to construct cabinetry. Such materials have frequently been incorporated in children's toys such as Lincoln Logs and Lego Blocks. However, many of these applications suffer from a restrictiveness in the creativity which may be manifested through constructions utilizing these devices. For example, Lincoln Logs may be configured only in a generally rectangular fashion due to the fixed interaction between the logs themselves. Similarly, Lego Blocks are generally designed to be interconnected in a rectangular fashion. Also, the blocks and other similar devices may only be linked at set intervals determined by the locking design of the device. The only provision for angular attachment is with specially shaped blocks. However, the interconnection of the various blocks is rigidly fixed by a peg and hole interaction. Further evidence of this may be found, for example, in various construction-type toys illustrated by Tinker Toys. Again the pegs and interconnecting blocks utilize a defined receptacle for holding the coupled block or pole in a definite configuration. Although each of the above described prior art systems utilize somewhat different locking or connecting methods, none combines these locking methods to provide imaginative flexibility of interconnection in a single system. Nor can any of these systems be readily used with any other such system.

Accordingly, the prior art generally has failed to recognize the desirability of providing a set of construction materials which may be manifested as an adult or juvenile toy which does not suffer from the various drawbacks outlined above. More specifically, it may be desirable to provide a set of materials or interlocking pieces which may be readily reconfigured in an infinite number of arrangements limited only by the imagination of the user. It may be further desirable to provide such a set of materials which may be interconnected in a variety of methods, rather than simply in the traditional methods outlined above. Accordingly, it is a principal object of the present invention to generally overcome the deficiencies present in the prior art.

It is a further object of the present invention to provide a set of construction-type materials which may be interchangeably interlocked in a number of reconfigurable positions not rigidly defined by the method of interlocking.

It is still a further object of the present invention to provide an imaginatively, analytically, visually and tactilely stimulating toy for both adults and children.

SUMMARY OF THE INVENTION

The present invention generally provides a set of three-dimensional, reconfigurable and interlocking construction pieces. Such pieces or elements may generally comprise any of a wide variety of randomly selected geometrical shapes which may be interlockingly configured in a virtually unlimited number of arrangements through a unique connection system. One or more of the pieces have a notch defined at one or more edges. The notch will generally have a width substantially equal to the edge thickness of the various geometric pieces and a variable depth. Various forms of the elements may then be joined in a traditional fashion of notch to notch or in a rectangular fashion by a notch crosswise to an edge. The various geometrical shapes may also be connected in a cantilever fashion by a friction fit created by a tip or corner of a geometric shape in conjunction with a notch on another geometric element. Also, two or more elements (or pieces) may be stacked to form a stable unit or may be otherwise combined to form a stable unit which can be stacked or balanced. Thus, a number of the elements may then be combined together in any combination of the above ways to create an imaginative design or sculpture or other constructed device.

Although in a preferred embodiment the geometric shaped pieces are all generally flat, additional envisioned embodiments include open-center pieces and irregular contour pieces. Such modifications fit within the system of the present invention as long as some portion of the piece proximate to its edge is of a sufficiently uniform thickness to provide cooperation with notches in other geometric pieces.

The inside edges of the notches and any of the geometric shapes or elements may be serrated to further facilitate a friction or contact fit between the geometric elements. The serrations may be either defined in the body of the geometric shape or may comprise a separate element to be inserted in the notch and bonded integrally with the remainder of the geometric element. The use of rubber or plastic ribs reduces the need for precision in manufacturing the elements and decreases wear and tear on the elements also. The rubber ribs may provide a cam-type action for cantilevering one geometric piece with other pieces.

Further, each entire geometric shape may be made of a flexible material. Such flexible materials may include rubber, polyethylene, polyurethane, or suitably non-rigid and/or low density plastics. These materials may be unsupported or may contain a shape retaining flexible web inner support designed not to puncture the element surface upon flexure. Flexibility further facilitates the cantilever effect and the friction fit between the corners of the geometric elements and the defined notches. Also, the use of flexible materials broadens the creative scope of use in interlocking the various elements, while at the same time greatly enhances the safety of the elements, especially with regard to children's use. Similarly, the edges of any of the geometric shapes may be alternatively defined to facilitate interlocking of the pieces. For example, grooves may be placed in the edge to accommodate portions of the notched sections or corners of the other geometric shapes.

Sets of configured shapes may be rigidly positioned against a desired mount through the provision of a described mounting device. An angularly positionable peg is provided for accommodation in a defined geometric shape which may be fixedly attached to the mount. The angular peg may then be selectively positioned in one of a plurality of angular orientations.

Additional modifications may be provided by a plurality of thicknesses of geometric shapes to allow for redundant positioning of elements on a particular mounting location. Also, the notches defined in any of the geometric elements need not be necessarily rectangular but may provide further flexibility in possible configurations through the use of angled notches, again having a width approximately equal to the thickness of the geometric shapes desired to be inserted therein.

BRIEF DESCRIPTION OF THE FIGURES

The novel features of the present invention are set forth with particularity in the appended claims. The objects and advantages of the present invention may be more fully understood by reference to the following detailed description taken in conjunction with accompanying drawings of which:

DETAILED DESCRIPTION OF THE INVENTION

While the invention will be described below in connection with several preferred embodiments, it should be understood that such description is not intended to limit the invention to the particular embodiments set forth. On the contrary, the present invention and description thereof is intended to cover all alternatives, modifications and equivalents as may be included within the spirit and scope of the invention as defined by the appended claims and as would be apparent to one of ordinary skill in the art and familiar with the teachings of this application. In this respect, the various elements of the present invention embodied in the interlocking blocks have been referred to (in the following discussion) as blocks, pieces, geometric shapes and geometric elements interchangeably without intention to limit the present invention to a single embodiment.

Figure 1:
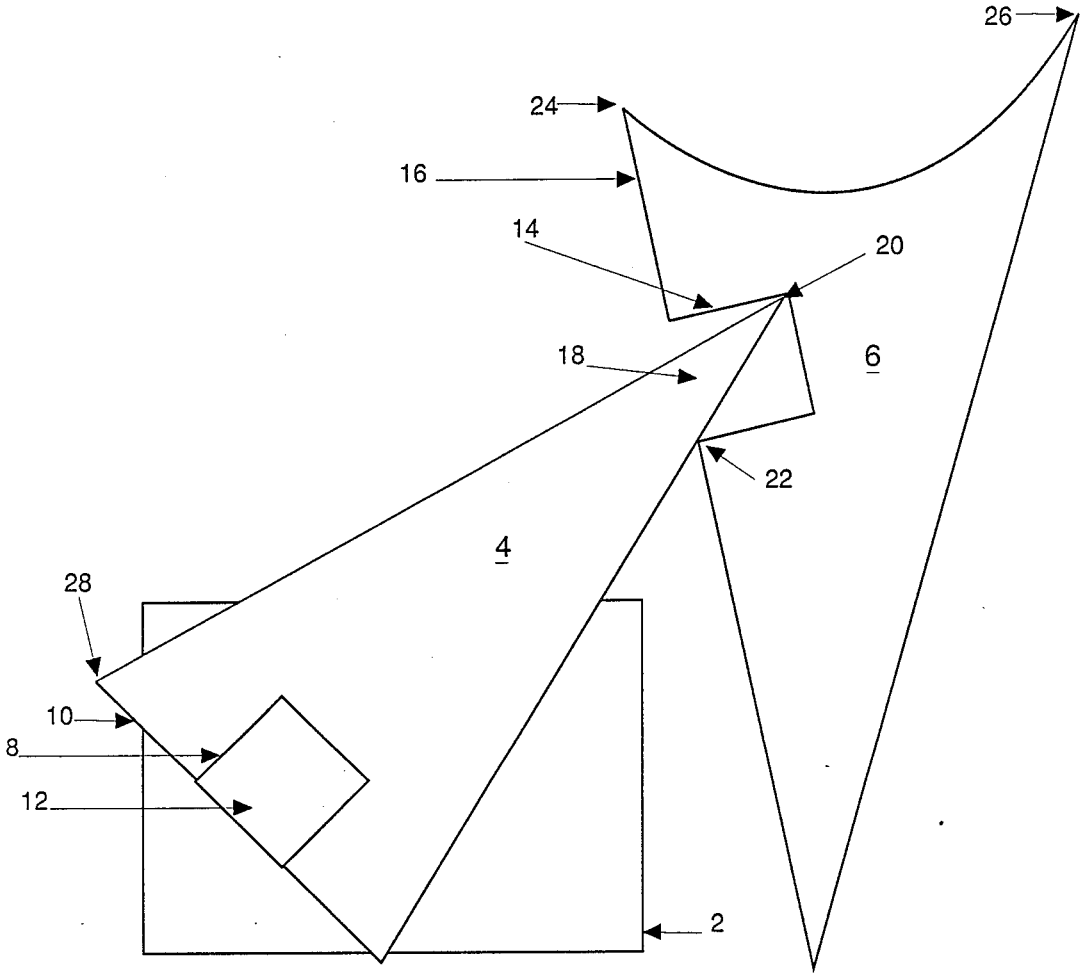
FIG. 1 is a side view of a set of interlocked reconfigurable geometric pieces in accordance with the present invention.

Referring now to FIG. 1, therein is shown a set of reconfigurable, interlocking geometric pieces suitable for use as a children's or adult game, as elements for imaginative art pieces, or as components for constructing large devices. More particularly, component geometric pieces 2, 4 and 6 may be configured as shown in FIG. 1 in accordance with the advantages of the present invention. Generally rectangular piece 2 is connected to a generally triangular piece 4 by interaction with a notch 8 defined in one edge 10 of triangular piece 4. This interconnection is further facilitated by means of a selectively rotatable block 12 which is attached to the rectangular piece 2 in a fashion described in more detail below. However, triangular piece 4 may alternatively be connected to rectangular piece 2 along any of the edges of piece 2 in a manner described in conjunction with the discussion of FIG. 3 below. Generally triangular piece 6 is then connected to generally triangular piece 4 by means of a notch 14 defined in edge 16 of piece 6 in conjunction with the tip region 18 of piece 4.

One of the novel features of the present invention is clearly illustrated in FIG. 1 through the various methods of interconnection between the different geometric pieces. More particularly, the provision of a notch in any one of the edges of the various pieces facilitates interconnection with the other pieces. As shown by the connection of piece 4 to piece 2, the notch may be connected in a fairly simple fashion through the generally rectangular piece 12 and the generally rectangular notch 8. This provides for a cantilever action about the notch 8 allowing piece 4 to be selectively positioned in a direction defined by the generally parallel sides of notch 8. Depending upon the degree of matching between piece 12 and notch 8, a friction fit may be generated between the corners of piece 12 and the inside edges of notch 8 which benefits from the additional pressures created as a torque about the area of interconnection by the cantilevered add-on of piece 6 to piece 4.

The second method of interconnection illustrated in FIG. 1 provides for the greater flexibility of the novel piece set of the present invention. The tip section 18 of triangular piece 4 interconnects with the notch 14 of piece 6 in a fashion which may generally be described as a two-point connection. That is, piece 4 at about its tip section 18 contacts piece 6 at only two points, 20 and 22, in the plane of the drawing. It will be appreciated that through the three-dimensional nature of each of the geometric shapes involved, that in three dimensions, contact is made only along two lines defined by the thickness of the various geometric shapes. Viewing point 22 as a pivot point, it will be appreciated that point 20 may be selectively positioned along two sides of notch 14 as described in more detail below. This allows for a great variety of cantilevered positions of piece 6 in relation to piece 4. Generally, the friction developed between the two points 20 and 22 in conjunction with gravity will be sufficient to maintain the piece 6 in the desired position. This friction may be further facilitated by provision of ribs along the inner edge of notch 14 as described in more detail below in conjunction with FIGS. 7 and 8.

Although just three geometric pieces are illustrated in FIG. 1 as comprising a set, it will be appreciated that the number of geometric pieces used in a set to create any desired configuration will be virtually unlimited. For example, an additional piece may be positioned along either of corners 24 and 26 of piece 6 in a fashion similar to the interconnection of piece 6 to piece 4. Similarly, an additional piece may be interconnected with piece 4 at its corner 28. Also, any number of additional pieces may be connected in a plane orthogonal to that of FIG. 1 through the relatively simple interconnection of a notch with the thickness of any of the three pieces 2, 4 or 6, illustrated in FIG. 1.

Figure 2:
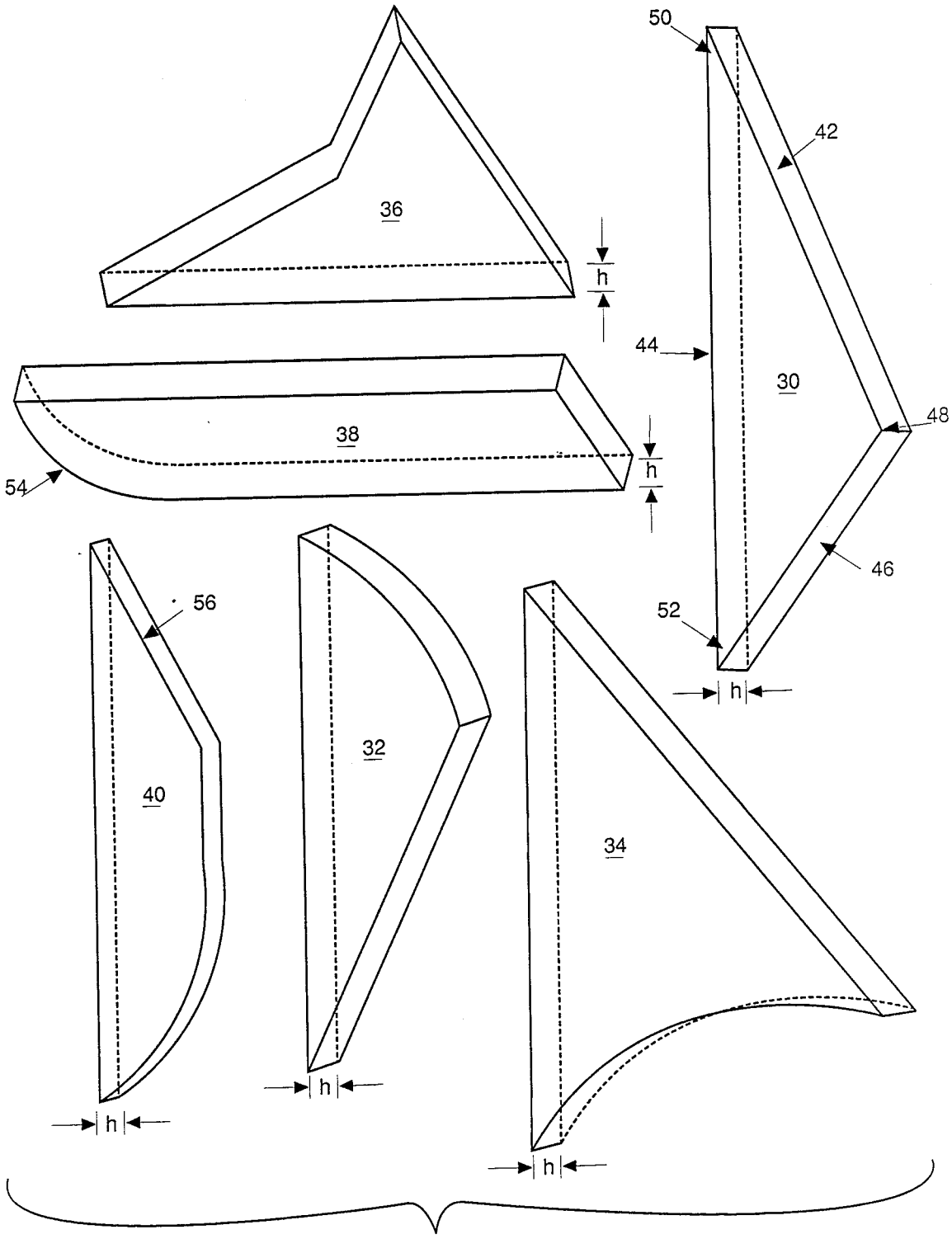
FIG. 2 is an illustrative collection of geometric shapes which may be used in conjunction with the present invention.

Referring now to FIG. 2, therein is shown a collection of geometric shapes 30, 32, 34, 36, 38 and 40 which are illustrative of the variety of geometric shapes which may be used in conjunction with the present invention. More particularly, geometric piece 30 comprises a generally triangular piece having a thickness of approximately a known value, e.g., a selected value h. The length of the sides 42, 44 and 46 may be selected and need not be any particular value. Similarly, the thickness h need not be of any particular value although it is envisioned that in the preferred embodiment, the thickness h of any geometric piece will be approximately equal to the width of the corresponding notches which may be defined in any of the edges of the geometric shapes. Likewise, the angles formed at each of the corners 48, 50 and 52 may be any desired angle, although large obtuse angles may be less well suited for the envisioned constructions and applications. Similarly, geometric shapes 32, 34 and 36 represent modified generally triangular shapes of the type which may be desirable for use in conjunction with the present invention.

Geometric shape 38 in FIG. 2 represents a slightly trapezoidal or rectangular geometric shape in which one side and one rectangular corner have been replaced with a generally circular portion 54. Such a shape may be desirable for use in conjunction in the present invention. Similarly, geometric shape 40 is similar to geometric shape 38 in that it is a modified rectangular piece. However, an additional angular section 56 has been included and replaces another corner of the generally rectangular shape.

Although the geometric shapes of FIG. 2 are shown as solid pieces, it is envisioned that in accordance with the present invention, all of the various pieces may be utilized in any number of construction or game sets and that at least some of the pieces utilized in each set would have at least one notch defined along an edge of the geometric shape. For example, generally triangular piece 30 may have one or more notches defined in any of sides 42, 44 and 46, such as those shown in FIG. 1. Likewise, open center pieces may be utilized in conjunction with suitable materials to provide another embodiment.

Although each of the geometric shapes of FIG. 2 are shown as having a thickness approximately equal to dimension h, the actual thickness of any of the pieces may vary as desired. The contours of the pieces may be irregular, even to the point where they may be texturally bumpy. However, it is envisioned that in the preferred embodiment, the generally uniform thickness enhances the reconfigurable, interlocking aspects of the present invention.

Figure 3:
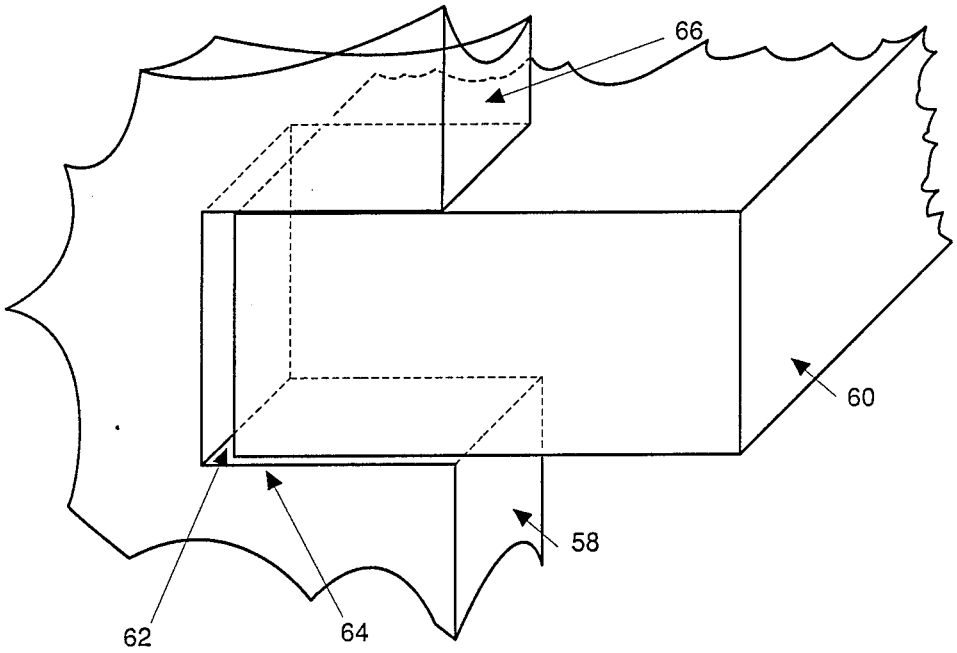
FIG. 3 is a first example of one method of interlocking which may be used in accordance with the present invention.

Referring now to FIG. 3, therein is shown a joint between one geometric piece 58 and a second geometric piece 60. Interconnections made between these respective pieces by insertion of one side 62 of piece 60 into a notch 64 defined in an edge 66 of piece 58. In this fashion, blocks 58 and 60 are joined in a substantially orthogonal manner.

Figure 4:
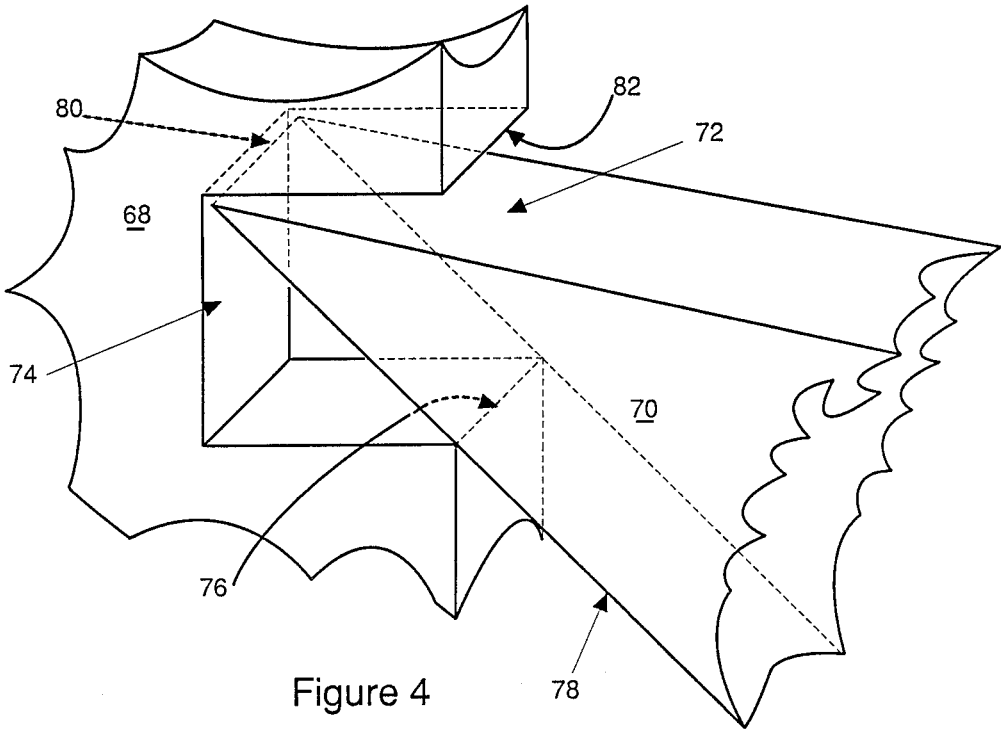
FIG. 4 is a second example of a method of interlocking geometric shapes which may be used in accordance with the present invention.

A substantially different connection and orientation between interconnected blocks is illustrated in FIG. 4. Therein, a geometric shape 68 is connected to a second geometric shape 70 by insertion of a tip portion 72 of block 70 into notch 74 of block 68. Actual physical contact between the two blocks takes place only along the line 76 defined by the lower front edge of notch 74 and the lower side 78 of block 70 and along the line defined by the tip 80 of block 70 along the point at which it contacts the top edge 82 of notch 74. This contrasts with the type of connection illustrated in FIG. 3 in which block 60 contacts block 58 along a substantially entire inner surface of notch 64. Accordingly, in this fashion, the friction generated along the two lines of contact allows the block 70 to be joined to block 68 in any number of angular orientations. This provides a great flexibility in the interconnection of the blocks, thereby allowing the exercise of substantial imagination in creating assorted cantilevered orientations. Generally, it is envisioned that such connections are possible when the included angle of tip portion 72 formed at the juncture of sides 78 and 79 is less than 90 degrees. Also, two or more pieces may be joined in a cantilevered fashion in more than one plane, rather than simply lying flat as shown in FIG. 4.

Figure 5:
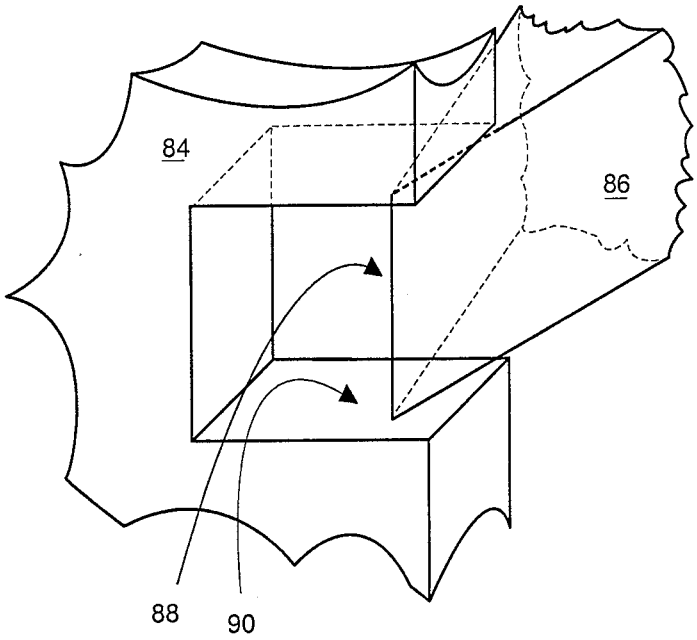
FIG. 5 is another example of a method of interlocking similar to that of FIG. 3.

Referring now to FIG. 5, therein is shown an interconnection between a block 84 and a second block 86. The type of connection illustrated in FIG. 5 is substantially identical to that of FIG. 3. However, a tip section 88 of block 86 is inserted into the notch 90 of block 84 rather than a more substantial portion of block 86. This again allows for flexibility and use of active imagination in the orientation created by the interconnection of the various blocks.

Figure 6:
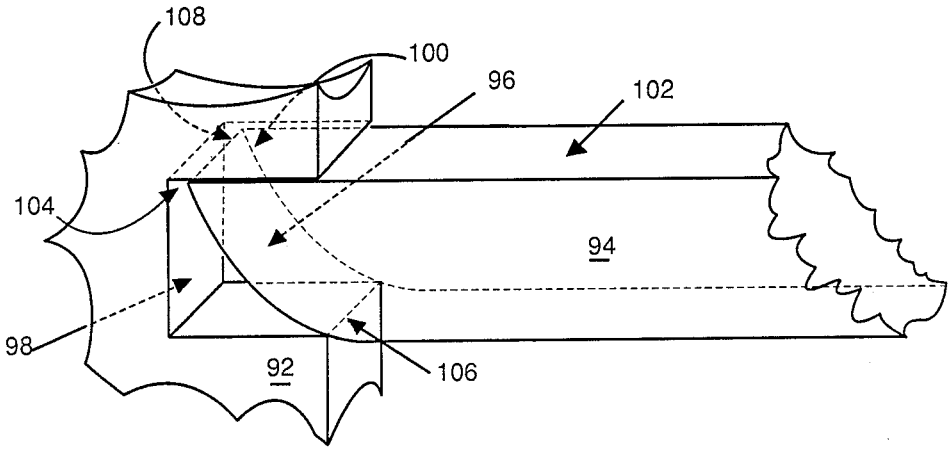
FIG. 6 is another method of interlocking geometric shapes similar to that of FIG. 4.

Referring now to FIG. 6, therein is shown another illustrative connection between various blocks 92 and 94 which may be utilized in accordance with the present invention. Again, a tip portion 96 of block 94 is inserted into the notch 98 of block 92. However, contact between the two blocks is limited to the surface shown as surface 100 along the top edge 102 of block 94 and the bottom edge 104 of the top of notch 98. Contact is also made between the two blocks along the line 106 defined by the lower corner of notch 98. This connection is similar to that illustrated in FIG. 4 and depending upon how far the tip portion 96 of block 94 is inserted into notch 98, block 94 may take on an orientation with respect to block 92 similar to that of block 70 with respect to block 68 as shown in FIG. 4. In this respect, the contact between the two blocks illustrated at surface 100 may be diminished to contact along lines 108 and 106 which would by friction hold block 94 in any desired orientation with respect to block 92.

Figure 7:
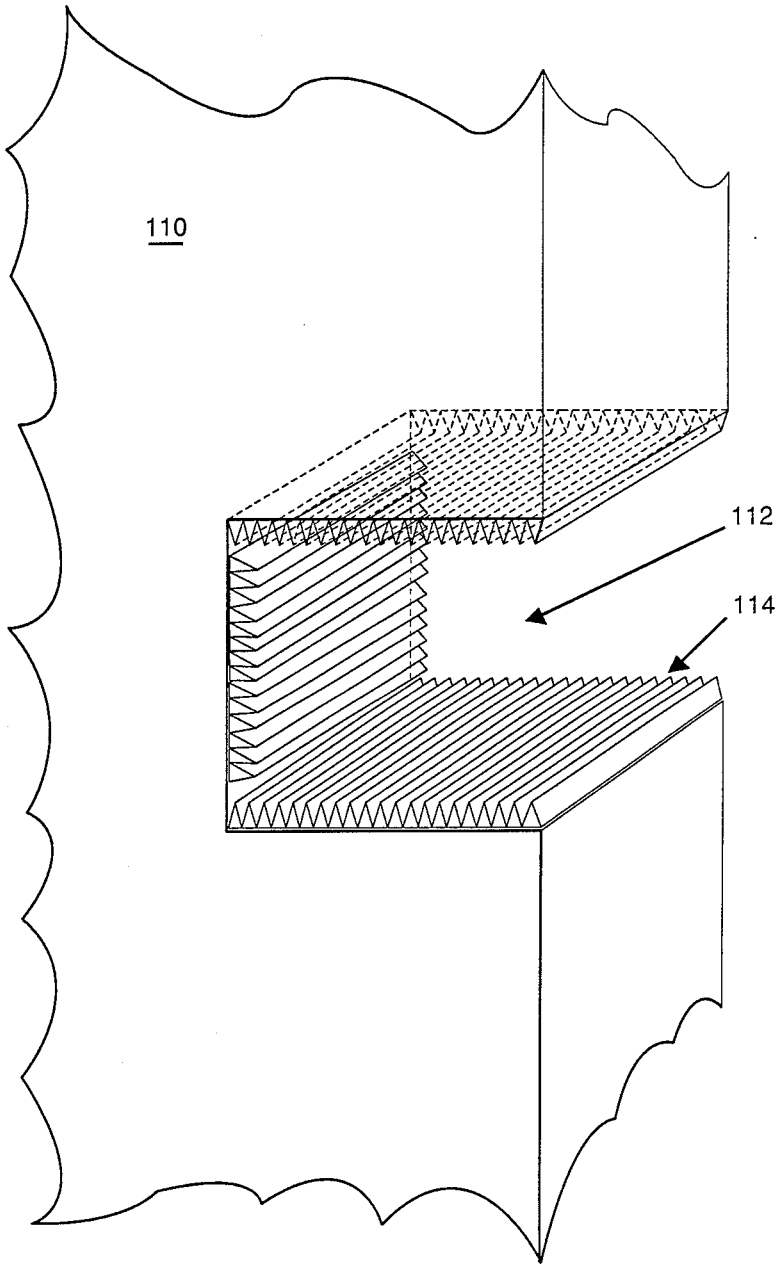
FIG. 7 illustrates a further embodiment of the notch feature of the geometric shapes of the present invention.
Figure 8:
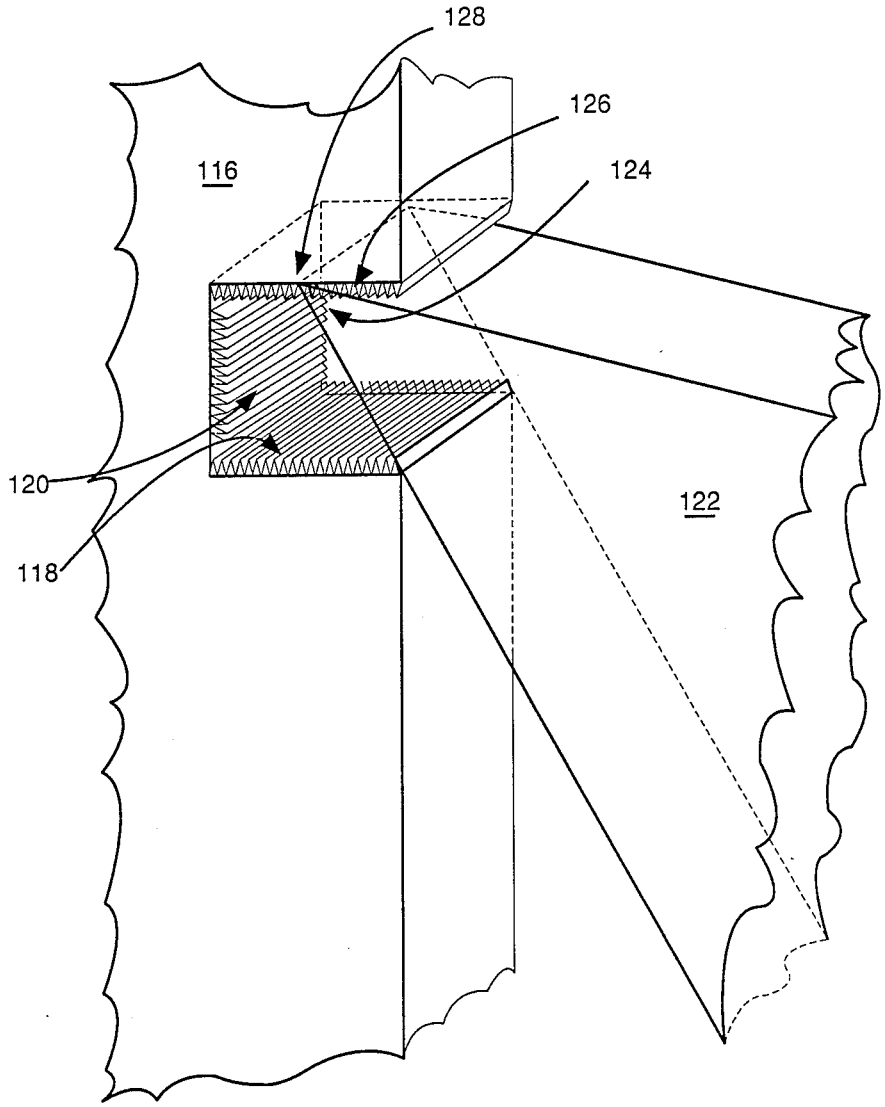
FIG. 8 illustrates the enhancement of the interconnection features through the embodiments of the notch shown in FIG. 7 with an illustration of the general advantages of the use of flexible material, particularly for ribs.

Referring now to FIG. 7, therein is illustrated a further embodiment of notch section 112 to be utilized in the set of building blocks in accordance with the present invention. The block 110 illustrated in FIG. 7 may be any one of the various shapes which are compatible with the present invention. However, the inner surface of notch 112 along its edges has been covered with a series of ribs 114 which may be utilized to further enhance the fit of additional component blocks into notch 112. When rubber or rubber-type flexible ribs are incorporated in the notch area, a tight friction fit may be readily established yet will require considerably lesser precision in the manufacture of the various pieces. The rubber ribs can be deformed to provide a cam type action on cantilevered pieces such as is shown in FIG. 8. Additionally, soft ribs serve to protect the surface of the pieces and reduce wear and tear on the pieces.

Such an interconnection is illustrated in FIG. 8 in which a block 116 having ribs 118 covering the entire inner surface of notch 120 is interconnected with a second block 122. As illustrated, the ribs 118 along the top edge of notch 120 tend to retard any slippage of tip section 124 of block 122 along the top surface 126 of notch 120. In a further preferred embodiment of the present invention utilizing such ribs along the edges of the notches, the ribs 118 of notch 120 would be comprised of a flexible material. This would further enhance the friction created between the tip portion 124 of block 122 and the upper portion 126 of notch 120. This is generally illustrated at the region 128 of FIG. 8 in which the ribs 118 are shown as being somewhat compressed in response to the pressure of the tip portion 124 of block 122 against them.

Alternatively, the "inner" surfaces of the notch may be cross-hatched or otherwise roughened to increase the friction generated between interconnected blocks. The use of softer, rubber-like material in the notch region increases the range of varying-thickness pieces which may be connected at the notch. Such provision may be most beneficial when the blocks are joined in a cantilever fashion, such as in FIG. 8, although considerable benefit may be expected in edge-notch connections also, shown in FIGS. 3 and 5. The use of taller ribs will presumably increase the tolerance range on variations in piece thickness and cantilever angle which will provide the desired interconnection.

Figure 9:
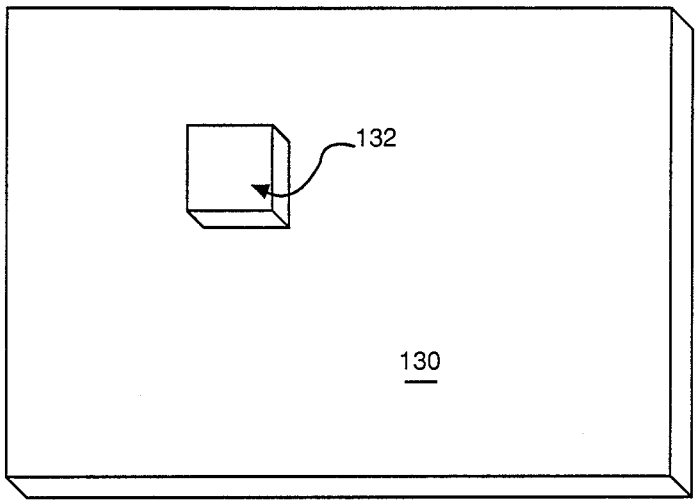
FIG. 9 illustrates a mounting block for use in conjunction with the geometric pieces of the present invention.

Referring now to FIG. 9, therein is shown a mounting block 130 which may be mounted against a wall or on a flat surface as an initial starting point for a configuration of blocks made in accordance with the present invention. On block 130 is selectively mounted a mounting post 132. It is envisioned that mounting post 132 may be selectively aligned in a number of angular positions so that the first geometric block to be interconnected with block 130 by this means may be positioned in any number of angular orientations. Such a use is illustrated in FIG. 1 through the means of block 12 mounted on the original block 2.

Figure 10:
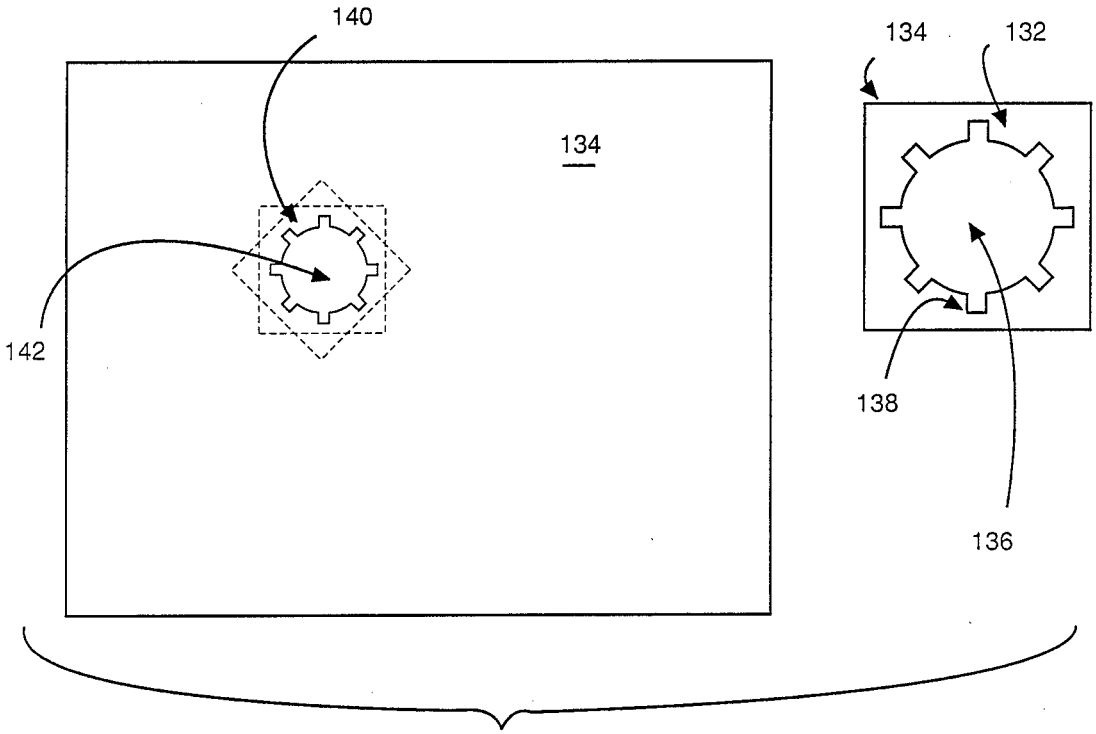
FIG. 10 illustrates the interlocking pieces of the board of FIG. 9 in the method of selective angular adjustment of the block portion.

FIG. 10 is an illustrative view from the back of block 130 shown in FIG. 9. It can be seen that block 132 comprises a generally rectangular mounting portion 134 secured to a rotation locking member 136 having a generally circular shape and having a series of locking keys 138 secured around its circumference. The locking keys 138 are designed to interconnect with key slots 140 which are defined along the circumference of a mounting hole 142 designed to accommodate the generally circular member 136 of mounting block 132. In this fashion, block 132 may be selectively aligned in this embodiment in various angular orientations as illustrated by the dashed lines in FIG. 10.

Figure 11:
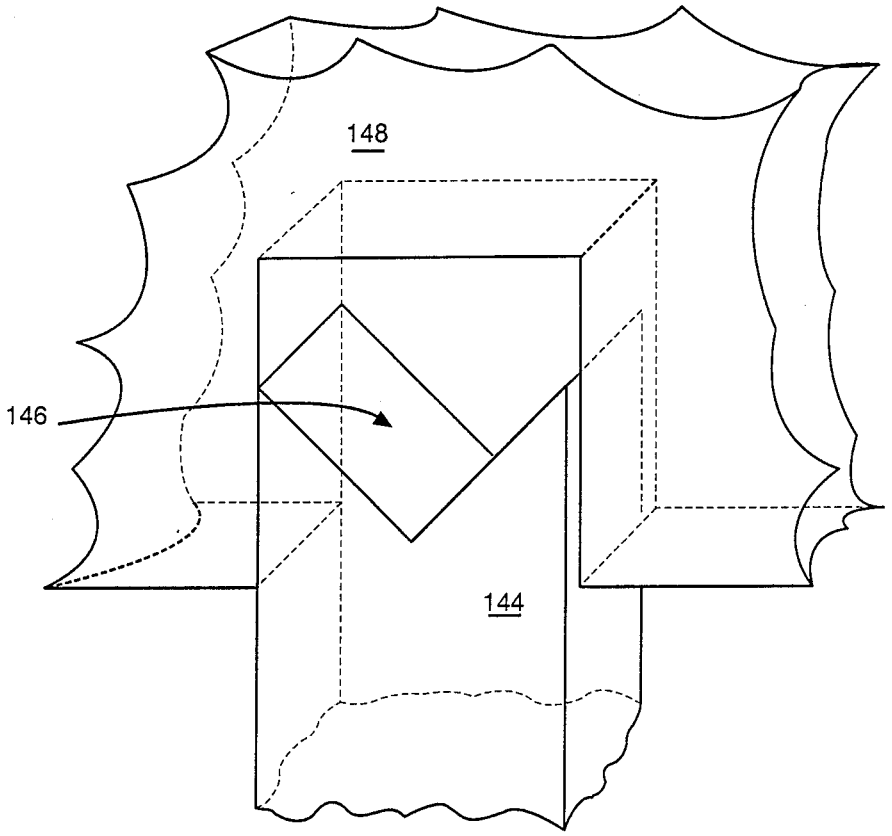
FIG. 11 illustrates a further embodiment of the edge portions of the various geometric shapes.
Figure 12:
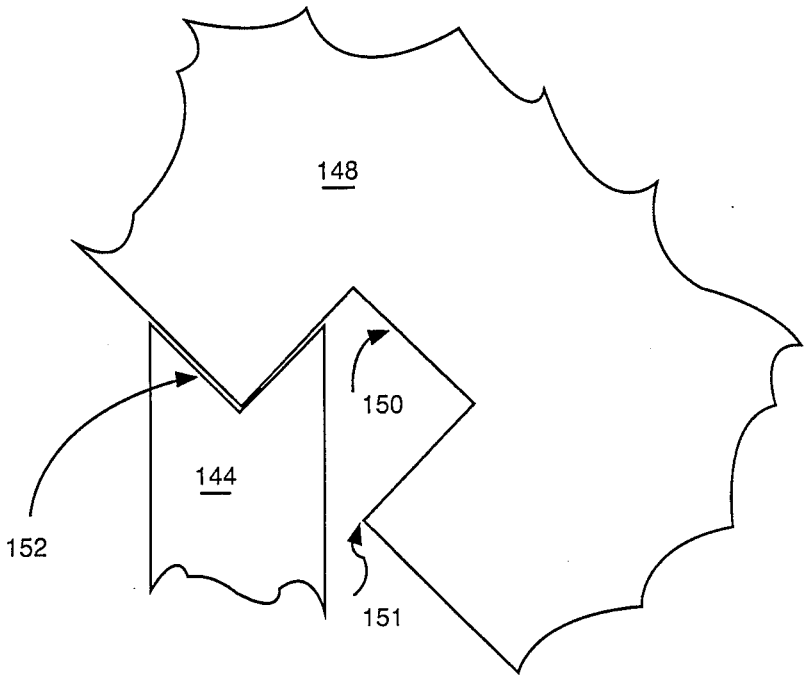
FIG. 12 illustrates a further interlocking method made possible through the use of the embodiment of FIG. 11.

Referring now to FIG. 11, therein is shown a further embodiment of the present invention in which an edge of block 144 has had a V-section 146 defined therein. As illustrated, block 144 may then be connected with a second block 148 in a fashion similar to that illustrated in FIGS. 3 and 5. Alternatively, block 144 may be interconnected with block 148 in the fashion illustrated in FIG. 12. In the configuration of FIG. 12, the notch 150 of block 148 is balanced on the V-section 152 of block 144. Naturally, the effective center of gravity of block 148 must be such to allow the balancing action, in that the friction generated between block 148 and V-section 152 will be generally insufficient to hold block 148 upright if the center of gravity is such as to cause it to tip. However, notch edge 151 may abut a side of block 144 to allow block 148 to be cantilevered across the top of block 144 as shown generally in the figure.

Figure 13:
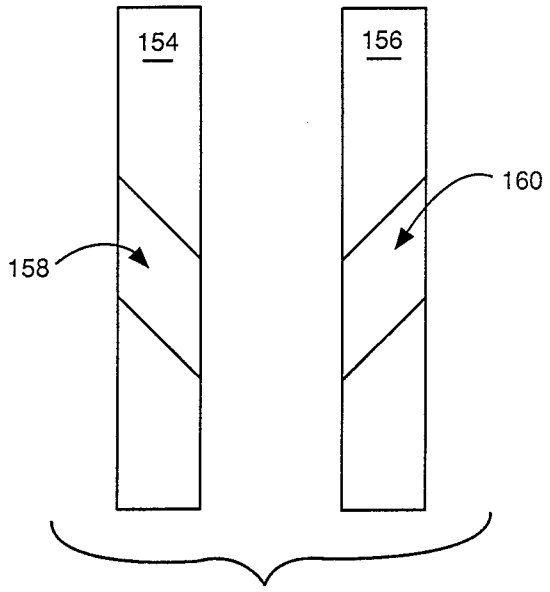
FIG. 13 illustrates a further embodiment of the notch portion for use on any of the geometric pieces of FIG. 2.

Referring now to FIG. 13, therein is shown two blocks 154 and 156 in which the notch section comprises a less traditional angular orientation in which notch sections 158 and 160, respectively, comprise a further embodiment. In FIG. 13, notches 158 and 156 are defined at an angle to the flat surfaces of the blocks rather than in the traditional orthogonal orientation illustrated in FIGS. 3 through 6.

Figure 14:
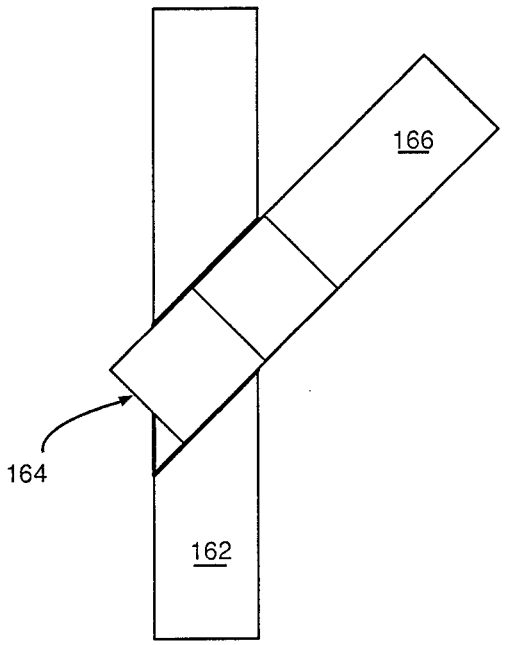
FIG. 14 illustrates a further interconnection position made possible through the use of the embodiment of FIG. 13.

An example of the configurations made possible through the use of the embodiment of FIG. 13 is illustrated in FIG. 14 in which a block 162 having an angled notch section 164 is interconnected with a block 166. Again, this provides yet another orientation of the reconfigurable blocks made in accordance with the present invention and allows for further exercise of imagination in their interconnection.

It is envisioned that the construction pieces of the present invention generally are blocks formed geometric shapes, which may be comprised of any suitable materials. Prototype blocks have been constructed utilizing wood of various sizes due to the ease of handling in a workshop. Alternatively, blocks could be constructed of high grade metal, cast of platinum or silver in an ornamental fashion, or constructed of a flexible, plastic material. Such flexible plastic materials may consist of virtually any contour-retaining elastomeric material such as rubber, polyethylene, polyurethane or other non-rigid and/or low-density plastics. In this last example, the blocks may be blow molded or formed. Likewise, it is envisioned that the pieces may be inflated with sufficient wall weight to still be stackable, much in the fashion of a weighted beach ball.

It is envisioned the use of flexible material may further facilitate utilization of present invention in an environment suitable for use by children by enhancing the safety of usage. Several fabrication benefits may be realized from the use of flexible materials. For example, the shapes or pieces may be molded rather than cut and carved as when wood or metal materials are used. Likewise, the ribbing in the notch area may be integrated in the same molding process.

Additionally, generally flexible material may be desirable to further enhance the friction between the blocks for interconnection, particularly in the cantilevered connections which rely upon a somewhat limited friction between the interconnected blocks for structural stability. The use of flexible materials also reduces the need for precision in manufacturing as a flexible notch and a tip or side of a flexible block may be more readily interconnected. In this sense the use of flexible materials may be said to "forgive" deviations in construction.

Figure 15:
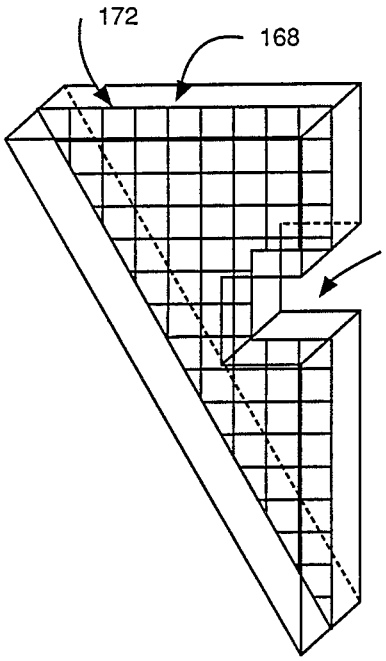
FIG. 15 illustrates an embodiment of a triangular geometric shape made of clear plastic material, preferably of a moldable, generally slightly pliable composition, with reinforcing mesh material contained therein.
Figure 16:
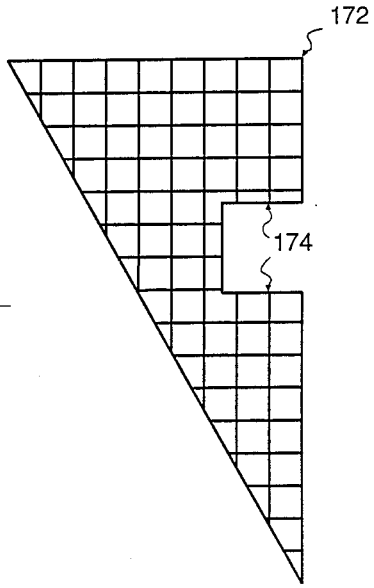
FIG. 16 illustrates the reinforcing mesh which may be used in the geometric pieces of the present invention to facilitate flexibility while generally retaining the desired geometric dimensions, e.g., notch width and depth and edge thickness. This figure further illustrates that a deformed shape may be retained by a geometric piece containing the mesh, depending upon the elasticity and resiliency of the mesh.

Referring now to FIG. 15, therein is shown a generally triangular geometric shape or block 168 having a notched section 170 made in accordance with the teachings of the present invention. In the illustrated embodiment, it is envisioned that the block 168 is generally constructed of a translucent flexible material. To add further strength to the flexible material, a reinforcing mesh 172 has been molded in place with the block 168. The mesh 172, which is shown in greater detail in FIG. 16, desirably has the same general outline as the block or geometric shape for which reinforcement is desired and further serves the function of generally retaining the geometric outline, particularly in the region proximate to the notch, while at the same time allowing flexibility of the overall block. Such mesh may be constructed of lightweight aluminum, high-grade steel, or of a stiff polyethylene or polystyrene which may be safer for use in applications involving children's toys, and would preferably be sufficiently pliable as to be unable to puncture the surface of the block. A further possible embodiment may be realized when the mesh is sufficiently pliable yet non-elastic as to retain the various pieces in selected, deformed states as desired.

The mesh may be incorporated as a part of the piece wall with thin walls or integrally in the piece wall with thicker walls. Two or more mesh units may be utilized in any piece to achieve the desired resiliency in three dimensions.

Additionally, the edges 174 of the notch 170 in mesh 172 may be biased in toward the notch area of the block in a spring-like fashion either by the construction of the mesh 174 or by addition of biasing elements such as steel springs. Such a modification may further enhance the connectability between blocks as the spring action in the notch region may more readily grip non-uniform edge regions of interconnected blocks. This may also be accomplished by utilizing more resilient materials in the wall construction.

Although illustrated above as generally comprising blocks of generally uniform thickness, it is foreseeable that any set of geometric shapes or blocks made in accordance with the present invention may comprise a series of blocks of varying thickness. In this respect, use of varying thickness blocks may lead to some loss in flexibility of configuration due to reduced friction between otherwise standardized notches for interconnection. In this respect, the use of the flexible ribs illustrated in FIGS. 7 and 8 may further enhance a variation between thicknesses of the various blocks.

As described above, the present invention allows for the interconnection of various geometric shapes in a myriad of overall configurations limited only by the imagination of the party utilizing the blocks. In this respect, although described above as a generally rectangular shape, the notch defined in any of the geometric shapes utilized may comprise virtually any shape just as the blocks themselves may comprise virtually any geometric shape. For example, trapezoidal shaped notches may work just as well as the rectangular. It is only necessary that the notches as used provide a sufficient friction surface to hold the blocks in interconnection, preferably in the cantilevered fashion described above.

What is claimed is:

1. A reconfigurable set of interconnectable playthings comprising:

a plurality of three-dimensional shaped pieces having substantially uniform thickness in at least one portion proximate to an edge and each having one or more sides of varying lengths connecting front and back faces of substantially identical outline; only one side in at least one of said objects further having a generally rectangular notch defined therein, said notch having a width substantially equal to said uniform thickness and a selected depth and including a plurality of ribs extending from said front face to said back face along one or more edges of said notch, said ribs being formed of a generally elastomeric material adhered to the edges of said notch, whereby said ribs enhance the friction fit of others of said objects;

said notch being adapted to receive by friction fit a tip or corner of others of said objects in a cantilever fashion along a side or point formed at the juncture of two sides.

2. The appaatus of claim 1 wherein said pieces are formed of a generally contour-retaining elastomeric material.

3. The apparatus of claim 2 wherein said generally contour-retaining elastomeric material further contains a reinforcing mesh, shaped to generally match the shape of the piece.

4. The apparatus of claim 3 wherein said reinforcing mesh in combination with said elastomeric material retains said piece in one or more selected shapes.

5. The reconfigurable set of claim 1 further including adjustable mounting means compatible with said notch to provide selective positioning of at least one piece in one of a plurality of selected angular orientations.

6. The apparatus of claim 1 wherein one or more of said pieces are generally triangularly shaped.

7. The apparatus of claim 6 wherein one or more sides of at least one of said generally triangularly shaped pieces are convexly curved.

8. The apparatus of claim 6 wherein one or more sides of at least one of said generally triangularly shaped pieces are concavely curved.

9. The apparatus of claim 1 wherein one or more of said pieces are generally rectangularly shaped.

10. The apparatus of claim 9 wherein one or more sides of at least one of said generally rectangularly shaped pieces are convexly curved.

11. The apparatus of claim 9 wherein one or more sides of at least one of said generally rectangularly shaped pieces are concavely curved.

12. The apparatus of claim 1 wherein one or more of said pieces are generally circularly shaped.

13. A plurality of interconnectable, contoured construction blocks for constructing artistic designs of selectable composition, each of said contoured blocks comprising:

front and back faces of a selected outline, one or more side faces of a first thickness connecting said front and back faces of the edges thereof;

at least one of said faces in at least one of said contoured pieces having a generally rectangular notch defined therein of a width approximately equal to said first thickness and a selected depth;

said notch being adapted to accept others of said contoured pieces along any side face or at a juncture of any two side faces which forms an included angle of less than about ninety degrees;

said notch being provided with frictional elements extending from said front face to said back face, said frictional elements are generally elastomeric ribs comprising a separate element to be inserted into said notch and bonded integrally with the remainder of said contoured block, whereby said frictional elements enhance the fit of others of said contoured pieces.

14. The blocks of claim 13 wherein each block is composed of a flexible, generally elastomeric material.

15. The blocks of claim 13 wherein one or more blocks further include at least one fully-contained shape retaining reinforcing mesh to retain said blocks in one or more selected shapes.

16. The blocks of claim 13 further including at least one base block adapted for substantially stationary positioning and having a second member rotatably connected to said base block so as to be positionable in one of a plurality of selected angular orientations with said base block, said second member being compatible with said notch.

* * * * *